US005541711A

United States Patent [19]

Kisu et al.

[11] Patent Number: 5,541,711

[45] Date of Patent: Jul. 30, 1996

[54] CHARGING MEMBER HAVING A CAVITY, CHARGING DEVICE, PROCESS UNIT, AND IMAGE FORMING APPARATUS HAVING SUCH A CHARGING MEMBER

[75] Inventors: Hiroki Kisu, Fujisawa; Masaharu Ohkubo, Yokohama; Kazushige Sakurai; Michihito Yamazaki, both of Tokyo; Erika Asano, Kawasaki, all of Japan

[73] Assignee: Canon Kabushiki Kaisha, Tokyo, Japan

[21] Appl. No.: 853,441

[22] Filed: Mar. 18, 1992

[30] Foreign Application Priority Data

Mar. 20, 1991 [JP] Japan ..... 3-056859

[51] Int. Cl.[6] ..... G03G 15/02

[52] U.S. Cl. ..... 355/219; 361/221

[58] Field of Search ..... 355/219, 222, 355/221, 299; 361/225, 212, 220, 221, 222; 346/160, 160.1; 492/59

[56] References Cited

U.S. PATENT DOCUMENTS

| | | | |
|---|---|---|---|
| 4,823,689 | 4/1989 | Kishino et al. | 492/59 X |
| 4,851,960 | 7/1989 | Nakamura et al. | 361/225 |
| 5,126,913 | 6/1992 | Araya et al. | 361/225 |
| 5,132,738 | 7/1992 | Nakamura et al. | 355/219 X |
| 5,144,368 | 9/1992 | Ohzeki et al. | 355/219 |
| 5,146,281 | 9/1992 | Kisu | 355/219 |

FOREIGN PATENT DOCUMENTS

| | | |
|---|---|---|
| 0308185 | 3/1989 | European Pat. Off. . |
| 60-023874 | 2/1985 | Japan . |
| 60-23874 | 2/1985 | Japan . |
| 60-147756 | 8/1985 | Japan . |
| 63-208879 | 8/1988 | Japan . |
| 01179957 | 7/1989 | Japan . |

OTHER PUBLICATIONS

Patent Abstracts of Japan, vol. 9, No. 144 (P–365) (1867) Jun. 19, 1985.

Patent Abstracts of Japan, vol. 12, No. 499 (P–807) (3346) Dec. 27, 1988.

Patent Abstracts of Japan, vol. 13, No. 460 (P–946) Oct. 18, 1989.

Patent Abstracts of Japan, vol. 9, No. 320 (P–413) (2043) Dec. 14, 1985.

*Primary Examiner*—Arthur T. Grimley
*Assistant Examiner*—Shuk Y. Lee
*Attorney, Agent, or Firm*—Fitzpatrick, Cella, Harper & Scinto

[57] ABSTRACT

A charging member includes an electrode to be supplied with a voltage; a surface layer contactable to a member to be charged; and wherein a cavity is provided between the electrode and the surface layer. The cavity extends in a circumferential direction of the charging member and/or the cavity has a configuration to provide a substantially constant state of contact between the charging member and the member to be charged.

28 Claims, 7 Drawing Sheets

CHARGING MEMBER HAVING A CAVITY, CHARGING DEVICE, PROCESS UNIT, AND IMAGE FORMING APPARATUS HAVING SUCH A CHARGING MEMBER

FIELD OF THE INVENTION AND RELATED ART

The present invention relates to a charging member, a charging device having the charging member, a process unit having the charging member, and an image forming apparatus having the charging member. The charging member is used, for example, to charge a member to be charged such as a photosensitive member or a dielectric member.

In order to electrically charge a member, a charging device is known in which a charging member in the form of a roller or the like is contacted to the member to be charged. When the manufacturing accuracy of such a charging roller is not high enough, for example, if the charging roller is eccentric, the charging member may be partly spaced apart, and the charging becomes improper in such a portion. In order to avoid the occurrence of the space, the charging member is made of relatively soft material to form a sufficiently wide nip between the member to be charged and the charging member. If the sufficiently wide nip is formed with the use of the soft material, the proper distance is provided between the charging member and the member to be charged outside the nip, and therefore, the improper charging can be avoided. U.S. Pat. No. 4,851,960 which has been assigned to the assignee of this application has proposed that a conductive member is used which is supplied with an oscillating voltage in the form of an AC voltage biased with a DC voltage, and the conductive member is contacted to the member to be charged. More particularly, the charging member is contacted to the photosensitive drum, and the charging member is supplied with an oscillating voltage (Vac+Vdc) in the form of an AC voltage Vac having a peak-to-peak voltage Vpp which is larger than twice the charge starting voltage, biased with a DC voltage Vdc.

However, such a charging member has been found to have a problem. As shown in FIG. 10, the AC component Vac applied to the electrode 2-3 vibrates the charging member 2 with the result of vibration noise (charging noise).

SUMMARY OF THE INVENTION

The mechanism of the noise production has been investigated. This will be described referring to FIG. 10. In this Figure, designated by a reference numeral 1 is a photosensitive drum, which comprises a photosensitive layer 1-1, an aluminum base 1-2 which is electrically grounded, and the photosensitive drum 1 is rotated at a speed of 40 mm/sec.

Since the charging member 2 is supplied with the AC voltage component, the positive electric charge is induced on the charging member 2-1 side (EPDM or the like in which carbon is dispersed) of the photosensitive layer 1-1, and the negative electric charge is induced on the base layer 1-2 side of the photosensitive drum, as shown by a thick line in FIG. 10(*a*), at a certain instance. These electric charges are attracted to each other, and therefore, the surface of the rubber 2-1 is attracted to the photosensitive drum, so that it moves from the position indicated by the thick solid line to the position indicated by the thin solid line. When the polarity of the AC electric field starts to reverse, the positive charge of the rubber 2-1 and the negative charge in the drum base 1-2 are neutralized by the opposite polarity charge now induced. When the AC electric field changes from the positive side to the negative side, the positive charge on the rubber 2-1 and the negative charge on the drum base 1-2 are dissipated. As a result, the surface of the rubber 2-1 returns to the position indicated by the thin solid line (FIG. 10(*b*)). When the negative peak of the AC field is reached, the negative and positive electric charges are induced to the rubber 2-1 side and the drum base 1-2 side, respectively, as shown in FIG. 10(*c*). Then, the rubber 2-1 is moved again from the thick line position to the thin line position. The above-described motions are repeated so that the charging member 2 vibrates when the AC voltage is supplied. This has been found to be the cause of the charging noise. As will be understood from the above analysis, the charging member 2 vibrates twice in one period of the AC voltage, and therefore, the frequency f of the AC voltage and the vibration frequency F of the charging member 2 have the following relation:

$$2f\ (\mathrm{Hz}) = F\ (\mathrm{Hz}) \qquad 1$$

Accordingly, it is a principal object of the present invention to provide a charging blade, a charging roller, a charging device, a process unit and an image forming apparatus using the charging blade or the charging roller in which the charging noise can be reduced.

It is another object of the present invention to provide a charging blade, a charging roller, a charging device, a process unit and an image forming apparatus having the charging blade or the charging roller, in which uniform charging is carried out.

It is a further object of the present invention to provide a charging blade, a charging roller, a charging device, a process unit and an image forming apparatus having the charging blade or the charging roller in which a sufficient nip is formed between the charging member and the member to be charged, so that a proper charging operation is possible over the entire length of the charging blade or roller.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiments of the present invention will be described.

Figure 11:
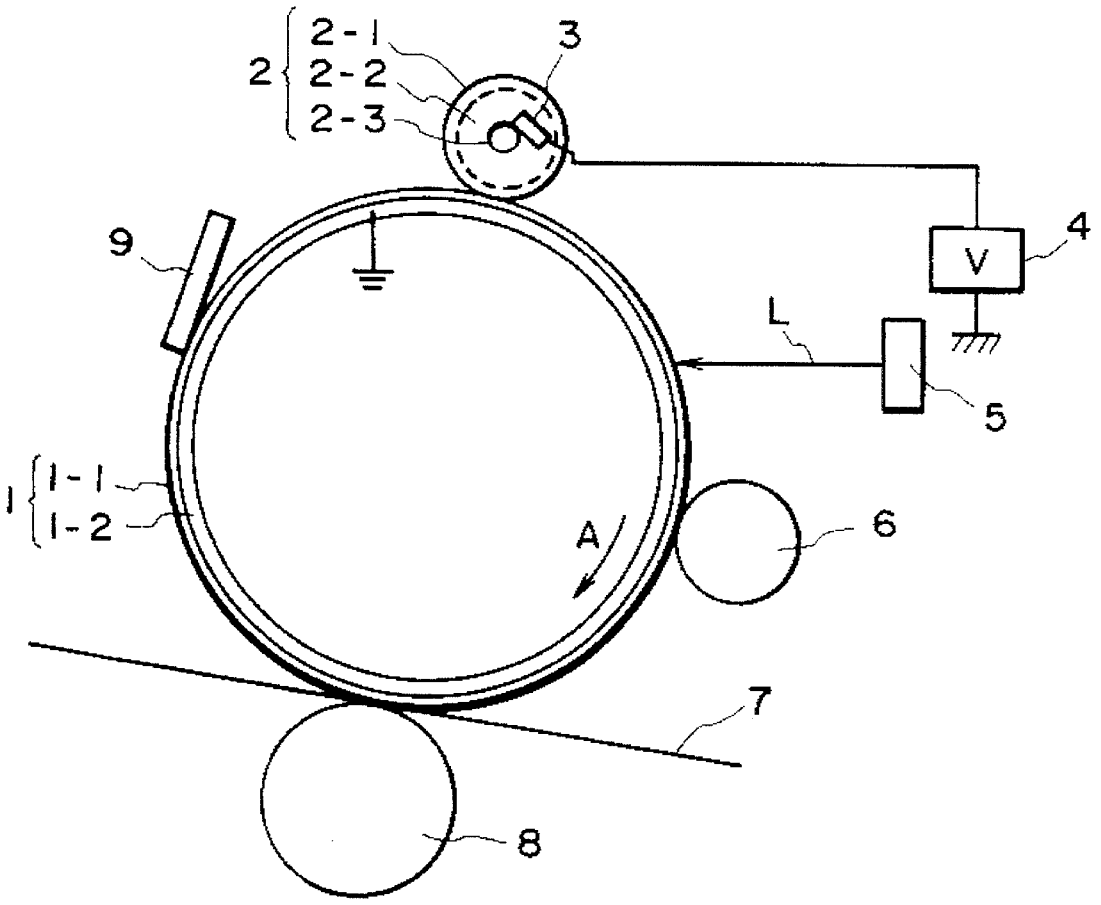
FIG. 11 is a side view of an image forming apparatus according to an embodiment of the present invention.

Referring first to FIG. 11, there is shown an exemplary image forming apparatus according to an embodiment of the present invention. It comprises a photosensitive drum (the member to be charged) including a base layer 1-2 of aluminum which is electrically grounded and a surface photosensitive layer 1-1. It is rotated in the direction A at a peripheral speed of 40 mm/sec. In this embodiment, the photosensitive layer 1-1 has a negative charging property and is made of an organic photoconductor.

The surface of the photosensitive drum 1 is uniformly charged by a charging roller (charging member) 2 contacted to the surface of the drum 1 and supplied with a voltage. Thereafter, a laser beam L which is modulated in accordance with image information is projected onto the photosensitive drum 1 surface from a laser beam scanner 5, so that an electrostatic latent image is formed. The electrostatic latent image is developed by a developing device (developing sleeve 6) with toner into a toner image. The thus produced toner image is transferred onto a transfer material 7 by a transfer roller 8 (transfer means).

After the image transfer, the transfer material 7 is introduced into an unshown fixing means, and the toner image is fixed.

On the other hand, the toner remaining on the photosensitive drum 1 after the image transfer operation, is removed by a cleaning blade 9 of a cleaning device, so that the photosensitive drum 1 is prepared for the next image forming operation.

Figure 1:
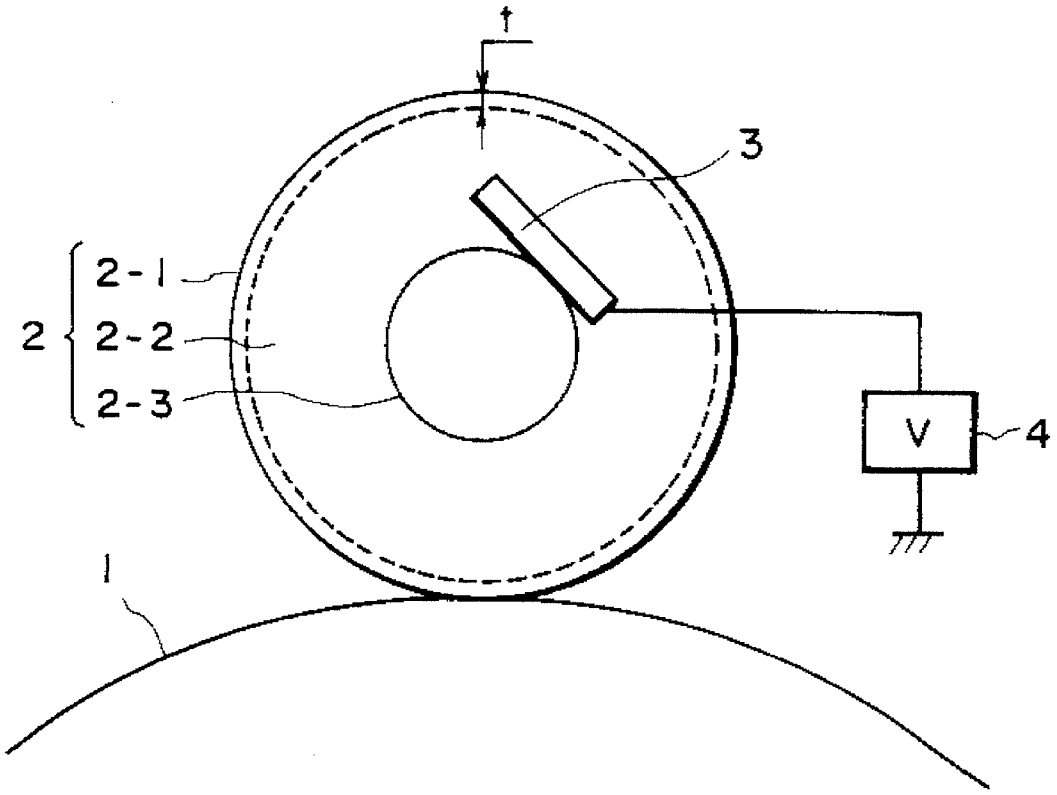
FIG. 1 is a side view of a charging member according to a first embodiment of the present invention.
Figure 2:
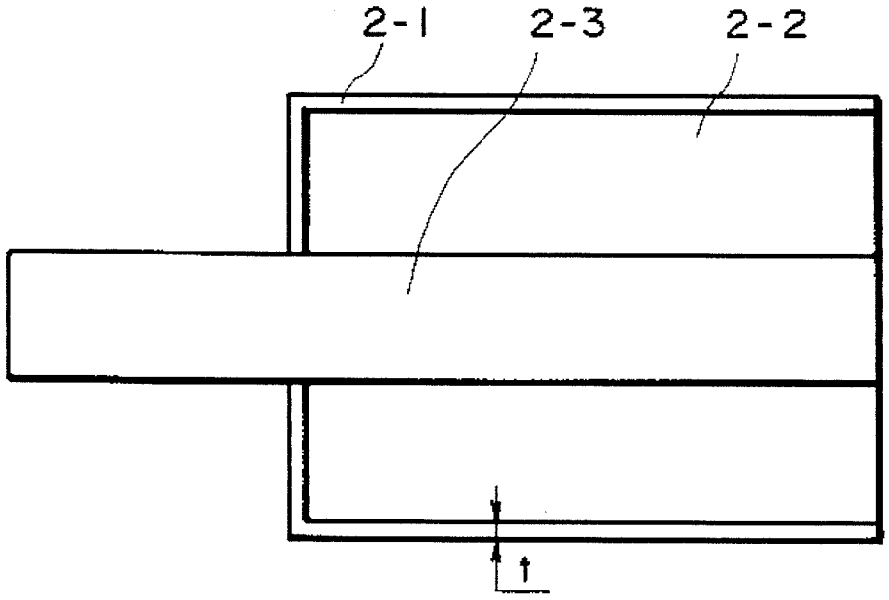
FIG. 2 is a front sectional view of the charging member of FIG. 1.

Referring to FIG. 1, the description will be made as to the charging member according to an embodiment of the present invention. The charging roller comprises a metal core (electrode) 2-3 made of stainless steel or the like, a surface layer 2-1 made of EPDM (ethylene propylene dien tercopolymer), urethane rubber in which carbon or tin oxide are dispersed as electrically conductive particles, and a cavity 2-2 which is filled with air, nitrogen, argon gas or the like. The cavity 2-2 extends in the circumferential direction of the roller 2 adjacent the core metal 2-3. It is preferable that the minimum cross-sectional area in the circumferential direction is not more than 70% of the maximum. Furthermore, as shown in FIGS. 1 and 2, it is preferable that the longitudinal sectional configuration of the cavity in the circumferential direction is substantially the same (irrespective of the radial direction), since then the noise does not change when the roller is rotated. In this embodiment, the surface layer 2-1 is 200 μm. The charging roller 2 is press-contacted to the photosensitive drum 1 at a predetermined pressure so that the charging roller 2 is driven by the rotation of the photosensitive drum 1 about a core metal 2-3 which functions as a rotational axis. When the surface of the photosensitive drum is sequentially charged by the charging roller, the cavity 2-2 is always formed between the core metal 2-3 and the surface layer 2-1.

The core metal 2-3 of the charging roller 2 is supplied with a voltage for charging the photosensitive drum 1 from a voltage source 4. More particularly, an oscillating voltage in the form of an AC voltage (peak-to-peak voltage of 2.0 KV and the frequency of 600 Hz) biased with a DC voltage (−700 V) is supplied to the core metal 2-3 through an electrically conductive spring 3. Here, the peak-to-peak voltage of the oscillating voltage applied between the photosensitive drum 1 and the charging roller 2 is preferably not less than twice the absolute value of the charge starting voltage of the photosensitive drum 1, from the standpoint of the uniform charging of the photosensitive drum 1. If the peak-to-peak voltage is smaller than twice the charge starting voltage, the charging noise is fairly smaller, but unevenness of the charging in the form of spots result. Microscopically, the contact surfaces of the charging member 2 and the photosensitive drum 1 involve fine pits and projections, and therefore, ideal surface to surface contact can not be provided. If the peak-to-peak voltage is smaller than twice the charge starting voltage, the uniforming effect is not provided. The produced spots appear in the resultant image, thus deteriorating the image quality. The charge starting voltage is defined as a DC voltage level at which the charging of the photosensitive drum 1 is started when only a DC voltage is applied between the photosensitive drum i and the charging roller (charging member) 2. In this embodiment, the charge starting voltage for the photosensitive drum 1 having an organic photoconductive layer is +560 V. In this embodiment, the peak-to-peak voltage was 2.0 KV (≧twice the charge starting voltage), and therefore, the surface of the photosensitive drum 1 was uniformly charged. The oscillating voltage is a voltage in which the voltage level periodically changed, and it may be a sine wave, triangular wave or it may be provided by rendering on and off a DC voltage (rectangular wave).

FIG. 2 is a sectional view of the device of FIG. 1. As will be understood from FIG. 2, there is a cavity 2-2 in the charging roller 2, and therefore, the charging roller 2 becomes light, and flexible. Therefore, the sufficient large nip width is provided between the charging roller 2 and the photosensitive drum 1, by which the clearance required for proper discharging action is formed between them. Thus, the improper charging can be prevented. The charging noise is decreased as compared with the conventional charging roller. This will be understood if the following fact is considered. When a music drum is beaten with light and soft stick made of foamed styrol material, the sound is lower than when it is beaten with a heavy and hard stick.

In addition, the cavity 2-2 is closed by the core metal 2-3 and the surface layer 2-1, the noise produced in the charging member does not leak outside, and therefore, the charging noise is further reduced. The electric power supply to the surface layer 2-1 is accomplished by the electric contact between the core metal 2-3 and the voltage supplying portion extending radially at the longitudinal end of the roller, as shown in FIG. 2.

The power supply portion or portions may be disposed outside a toner image formation area of the photosensitive drum 1 in the longitudinal direction of the charging roller or the photosensitive drum 1, since otherwise the toner may be fused on the photosensitive drum 1 at the power supply portion or portions.

Figure 10A:
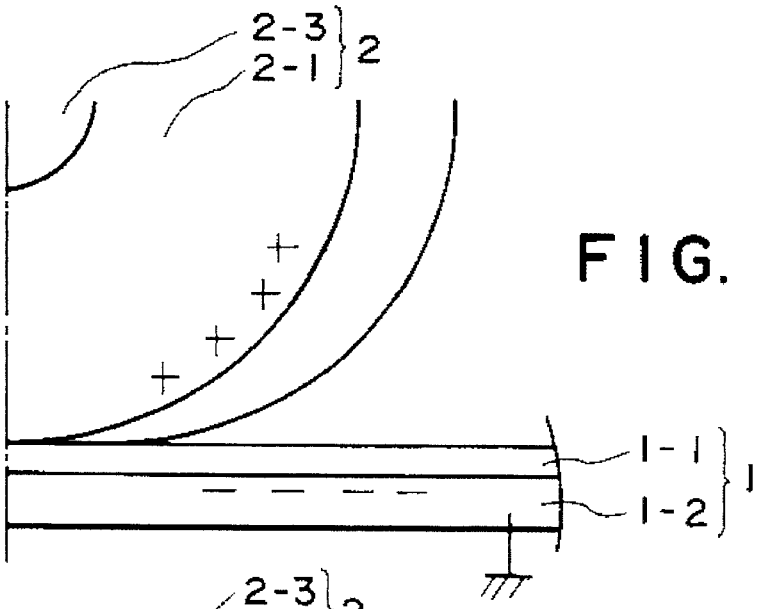
FIGS. 10A, 10B, and 10C are sectional views of a conventional charging member, illustrating the mechanism of noise production during the charging operation.
Figure 10B:
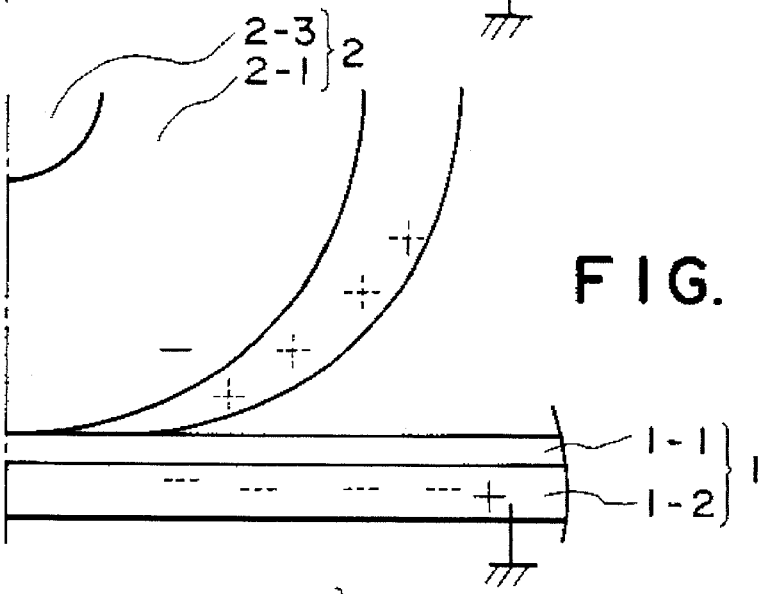
Figure 10C:
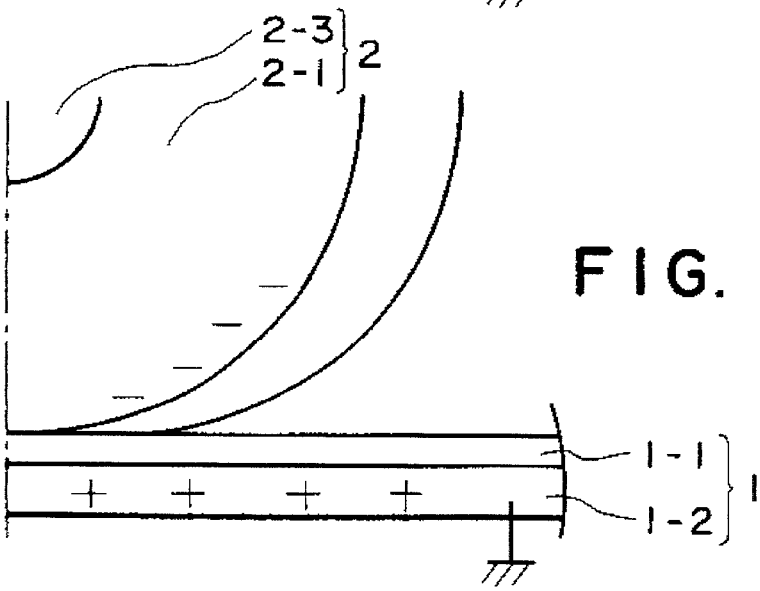

The device of FIG. 11 using the charging roller of FIG. 1 and FIG. 10 was set in an anechoic chamber, and the noise under the above conditions was measured. The measurements were effected in accordance with paragraph 6 of ISO 7779. In the case of FIG. 10 device, the noise was 55 dB, but in the case of FIG. 1 charging roller, it was 33 dB.

The thickness t of the surface layer 2-1 of the charging roller 2 is preferably 10 μm<t<10000 μm. If it is not more than 10 μm, the contact between the photosensitive drum 1 and the charging roller 2 is not stabilized with the result of improper charging. If the thickness t of the surface layer 2-1 is not less than 10000 μm, the charging roller 2 urges the toner particles to the photosensitive drum 1, with the result of the toner fusing on the photosensitive drum 1, which causes improper charging.

Figure 3A:
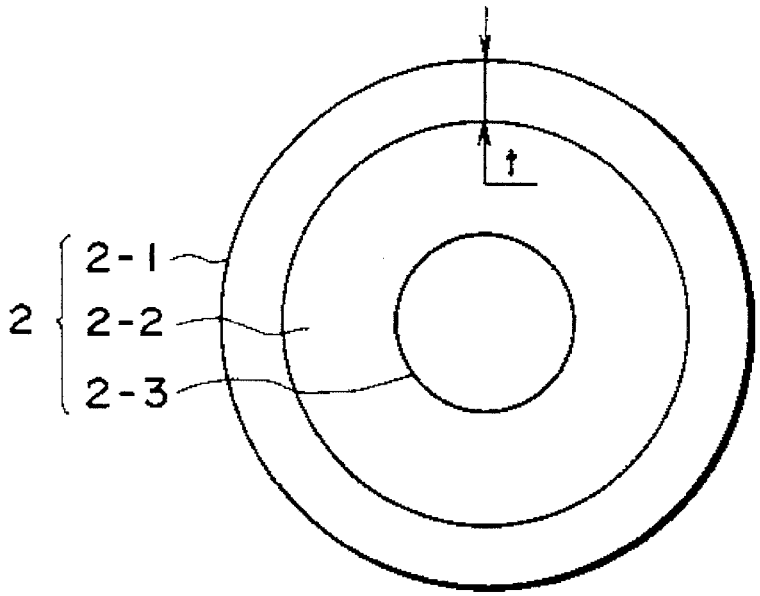
FIG. 3A is a side view of a charging member according to a second embodiment of the present invention.
Figure 3B:
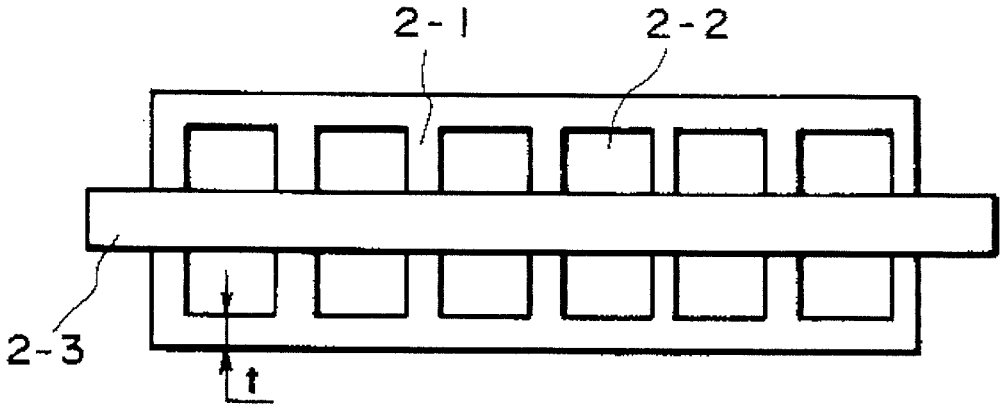
FIG. 3B is a front sectional view of the charging member of FIG. 3A.

FIGS. 3A and 3B show another embodiment of the charging roller 2. FIG. 3B is a sectional view of the device of FIG. 3A. In this embodiment, as shown in FIG. 3B, the cavity 2-2 of the charging member 2 is divided by partition walls substantially perpendicular to the core metal 2-3. This structure is effective to avoid reduction of the pressure to the photosensitive drum 1 in the longitudinally central region of the charging member 2. As a result, the nip width is not reduced in the central portion, and therefore, improper charging there does not easily occur. When the partition wall is made in the form of honeycomb in which the partition walls extend parallel to the core shaft, the charging noise varies each time the partition walls come to the photosensitive drum, with the result of larger charging noise. Therefore, it has been found that the partition walls substantially perpendicular to the core shaft are preferable. In this embodiment, the thickness t of the surface layer 2-1 was 200 μm. The measured noise was 38 dB. It is preferable that 10 μm<t<10000 μm for the same reasons as described hereinbefore.

Figure 4:
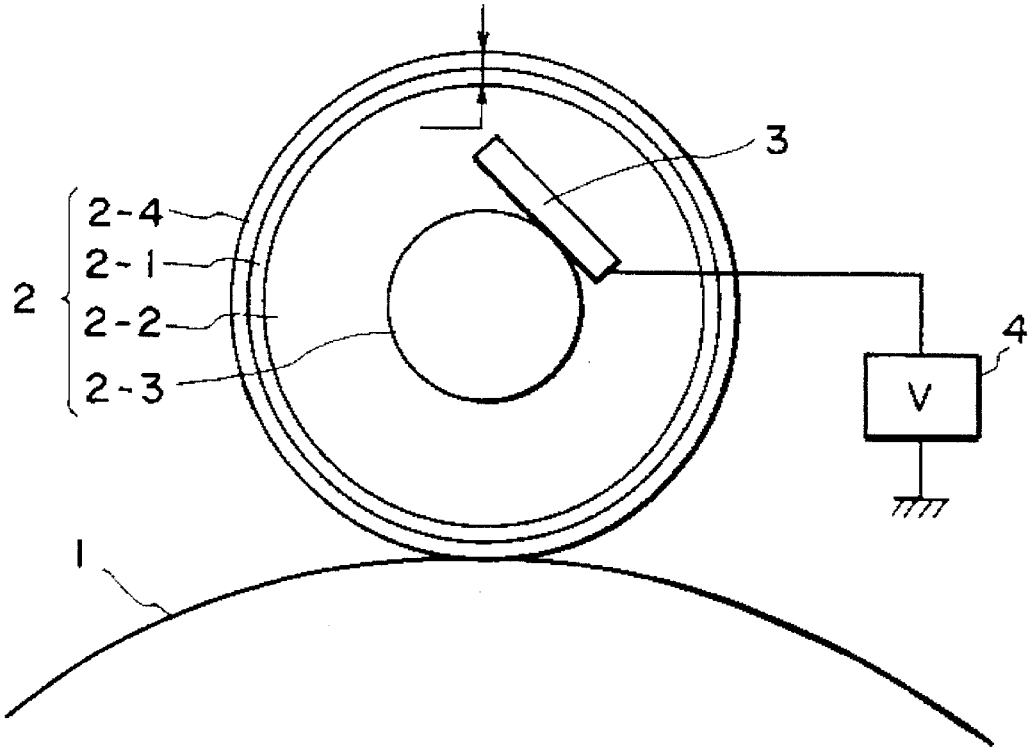
FIG. 4 is a side view of a charging member according to a third embodiment of the present invention.
Figure 5:
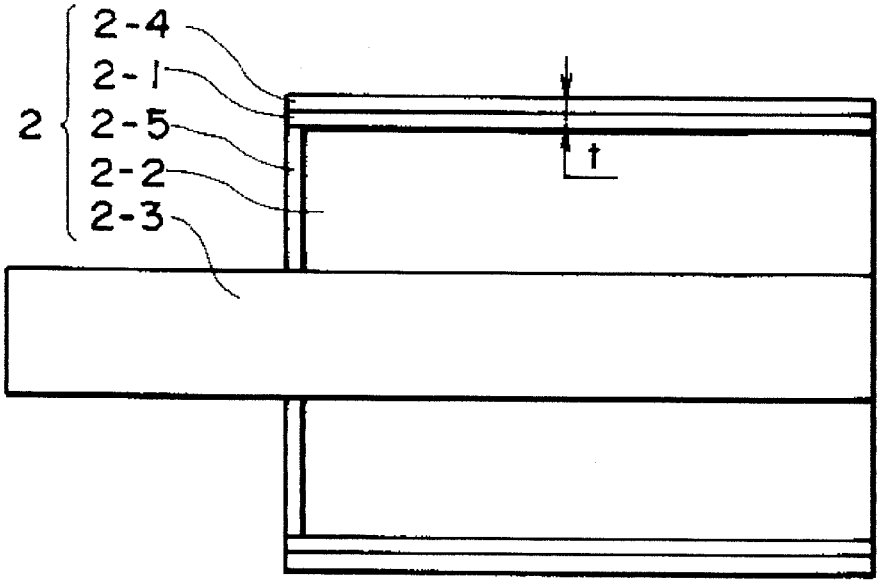
FIG. 5 is a front sectional view of the charging member of FIG. 4.

FIG. 4 shows another embodiment of the charging roller 2. In this embodiment, the reference 2-4 designates a high resistance layer made of hydrin rubber or paper. The high resistance layer is effective to prevent abnormal discharging which might occur when the charging roller is contacted to a pinhole portion of the photosensitive drum 1. The high resistance layer preferably has a volume resistivity of $10^7$–$10^{10}$ Ωcm. A low resistance layer 2-1 has a volume resistivity smaller than that of the high resistance layer, and is made of EPDM or the like containing a relatively large amount of carbon. It is effective to apply the bias voltage from the voltage source 4 to the backside of the high resistance layer 2-4. The device further comprises a flange (FIG. 5) made of metal or conductive resin or the like and functions as a voltage or power supply portion for electrically connecting the low resistance layer 2-1 and the core metal 2-3 supplied with the bias voltage. The power supply portion or portions 2-5 are preferably outside the toner image formation area of the photosensitive drum 1.

In this embodiment, the high resistance layer and the low resistance layer had thicknesses of 20 microns and 80 microns, respectively. Then, the charging noise was 41 dB which is practically low (<50 dB). As will be understood, the two layer structure is effective to reduce the charging noise, and also to prevent the abnormal discharging even if the photosensitive drum has a pin-hole or another defect. The total thickness t of the high resistance layer 2-4 and the low resistance layer 2-1 is preferably 10 μm<t<10000 μm, for the same reasons as described hereinbefore. The high resistance layer and the low resistance layer may be incorporated in the surface layer of the charging roller of FIG. 3.

Figure 6:
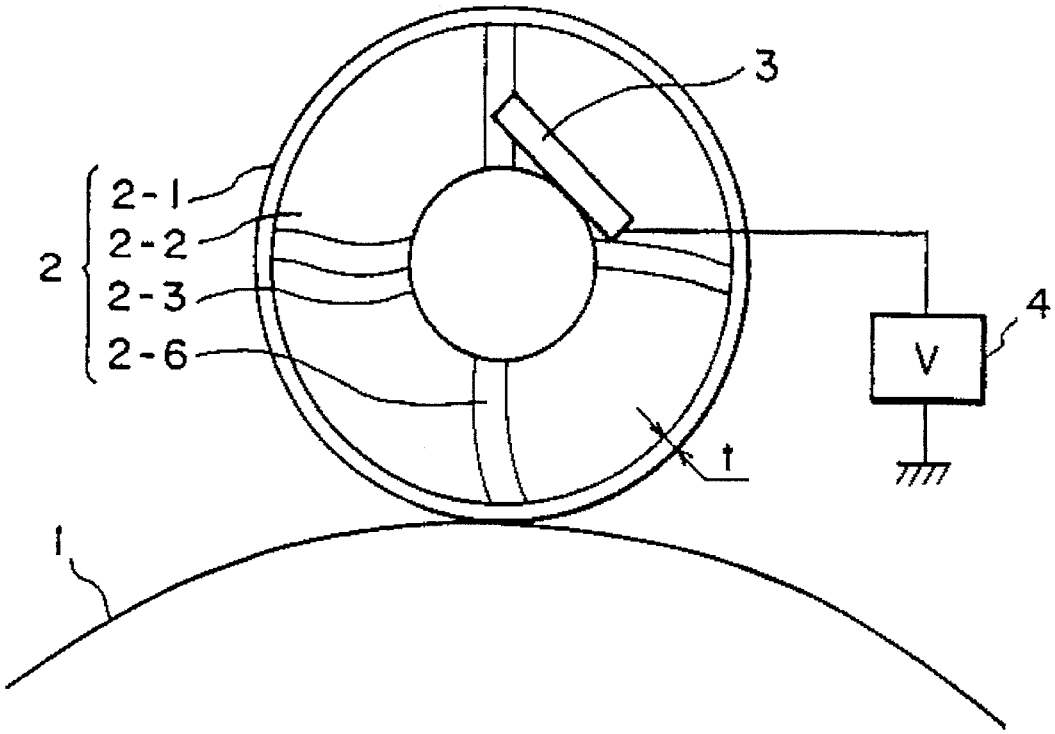
FIG. 6 is a sectional view of the charging member of the third embodiment.
Figure 7:
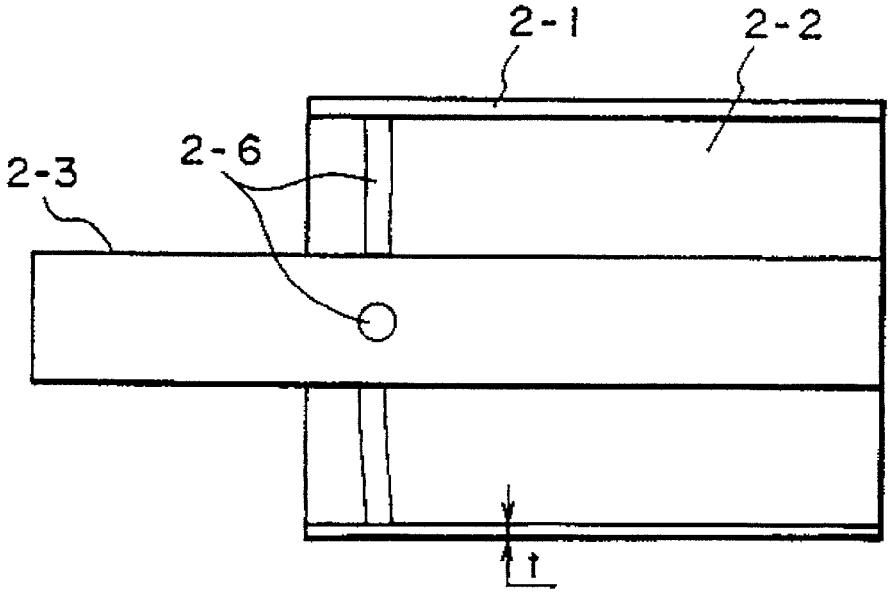
FIG. 7 is a front sectional view of the charging member of FIG. 6.

FIG. 6 shows a further embodiment, in which the charging member comprises a supporting member 2-6 made of EPDM or urethane in which a large amount of carbon is dispersed. This is effective to establish the electric connection between the surface layer 2-1 and the core metal 2-3. In this embodiment, the surface layer had a thickness t of 3 mm. In this case, even if the surface layer is vibrated, the supporting member 2-6 functions to absorb the vibration, and therefore, the core metal 2-3 is not vibrated. Therefore, the beating force to the photosensitive drum is small and therefore, the charging noise is also low.

With this structure, the nip between the charging member and the photosensitive drum is assured, and therefore, even if the force applied to the core metal 2-3 is made stronger, the end deformation is small so that the uniform nip can be provided over the entire longitudinal length, because the flexibility at the end portions of the charging roller 2 is large.

Figure 8:
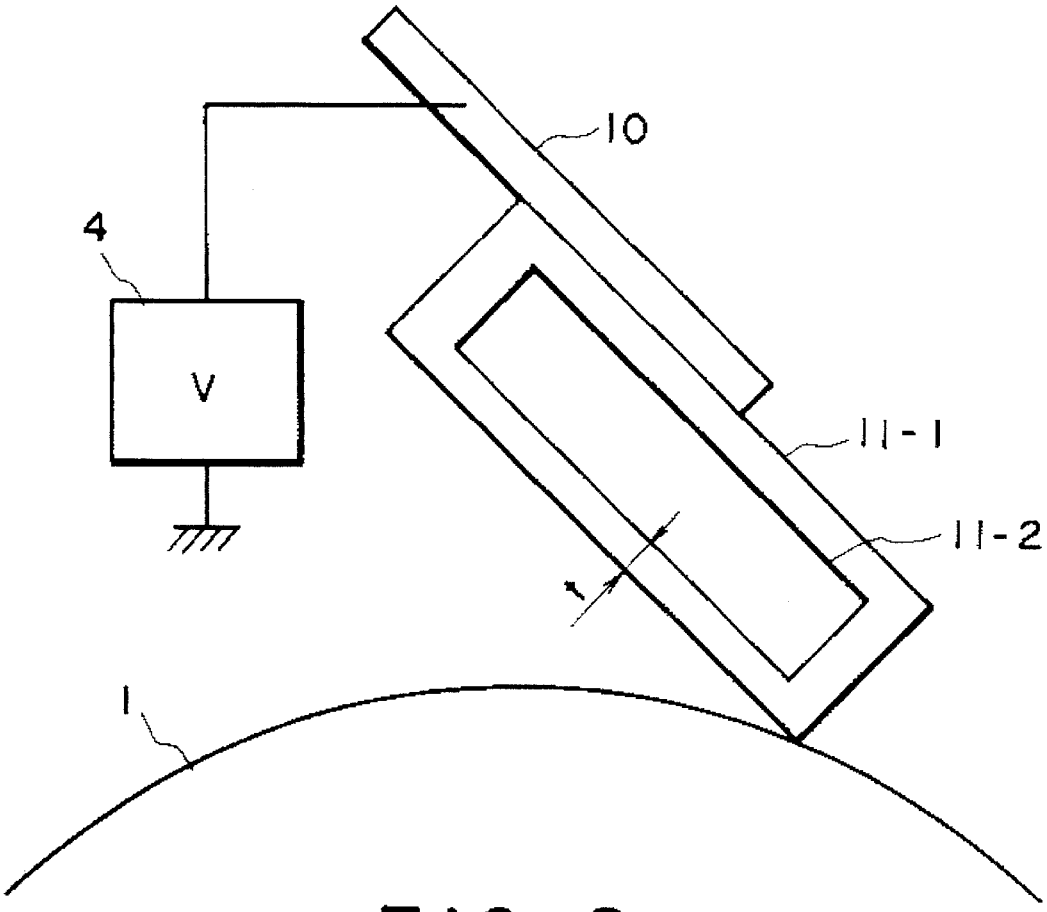
FIG. 8 is a sectional view of a charging member according to a fourth embodiment of the present invention.

FIG. 8 shows a further embodiment of the charging member, in which the charging member is in the form of a blade 11. It comprises a blade 11-1 made of EPDM, urethane resin or the like in which carbon, tin oxide or another conductive powder is dispersed, and a cavity 11-2 in the charging blade. It further comprises an electrode 10 for applying a bias voltage for the charging action and a voltage source 4 for applying the voltage to the electrode 10.

In this embodiment, the thickness of the surface layer of the charging blade 11 was 500 microns, and the charging noise was 40 dB.

In this case, a low noise charging member can be provided by the simple structure. In addition, the pressure of the charging member to the photosensitive drum 1 can be controlled using the rigidity of the charging blade. The thickness t of the surface layer of the blade 11 preferably satisfies 10 μm<t<10000 μm.

Figure 9:
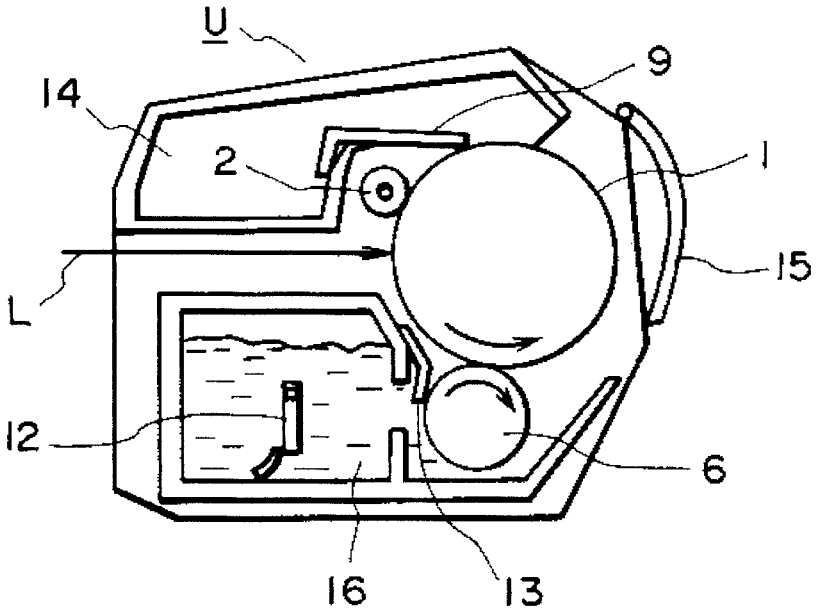
FIG. 9 is a sectional view of a process unit including a charging member according to an embodiment of the present invention.

FIG. 9 shows a process unit U having the charging member described above, according to an embodiment of the present invention. The process unit comprises a photosensitive drum 1, a charging roller 2, and a developing sleeve 6. The photosensitive drum 1 and the developing sleeve 2 are rotated in the directions indicated by the arrows. The photosensitive drum 1 is irradiated with a laser beam L for image formation. It further comprises a cleaning blade 9 for removing residual toner from the photosensitive drum 1, a drum shutter 15 for protecting the photosensitive drum from light. The developing device contains developer or toner 16. The developing device comprises a stirring rod for conveying the toner to the developing sleeve. The developing device further comprises a developing blade 13 for applying a uniform thickness layer of the developer on the developing sleeve, a toner container for containing the toner removed by the cleaning blade 9.

The process unit U is detachably mountable relative to the image forming apparatus. The unit may contain at least the image bearing member (photosensitive drum 1) and a charging member (charging roller 2). Because of the structure described above, when the process unit U is mounted in the main assembly of the image forming apparatus, the photosensitive drum 1 is charged by the charging roller with low or no noise, and the electrostatic latent image is formed on the photosensitive member by an imagewisely modulated laser beam L. The thus formed electrostatic latent image is developed by the developing sleeve 6 into a visualized image. The developed image is transferred onto a transfer material by an unshown transfer means, and is conveyed to an image fixing device.

As described hereinbefore, according to the present invention, the process unit which is light, compact and noiseless can be provided.

In the foregoing embodiments, the charging polarity of the photosensitive member was negative, but it may be positive.

Thus, the hollow structure of the charging member is effective to suppress the charging noise. According to the present invention, the reduction of the noise permits the use of higher frequency of the voltage source. This is effective to increase the process speed.

While the invention has been described with reference to the structures disclosed herein, it is not confined to the details set forth and this application is intended to cover such modifications or changes as may come within the purposes of the improvements or the scope of the following claims.

What is claimed is:

1. A charging roller comprising:

an electrode to be supplied with a voltage having an oscillating component;

a surface layer contactable to a member to be charged; and a support between said electrode and said surface layer to support said surface layer, wherein a cavity is formed between said electrode and said surface layer, and said support is provided only partially in a longitudinal direction of said roller.

2. A charging roller according to claim 1, wherein said surface layer has a thickness t satisfying 10 μm<t<10000 μm.

3. A charging roller according to claim 1, wherein said electrode constitutes a shaft for said charging roller.

4. A charging roller according to claim 1, wherein said cavity is disposed adjacent said electrode.

5. A charging roller according to claim 1, wherein said cavity is sealed.

6. A charging roller according to claim 1 or 5, further comprising a power supply portion for supplying the voltage to said surface layer through said electrode.

7. A charging roller according to claim 6, wherein said power supply portion is disposed adjacent a longitudinal end of said charging roller.

8. A charging roller according to claim 1, wherein said cavity has substantially an identical configuration in any longitudinal cross-section along an axis thereof.

9. A charging roller according to claim 1, wherein said surface layer comprises a first resistance layer to be contacted to the member to be charged and having a first volume resistivity and a second resistance layer inside the first resistance layer and having a second volume resistivity smaller than the first volume resistivity.

10. A charging device comprising:

a charging member continuously charging a surface of a member to be charged, said charging member being in the form of a roller;

said charging member including an electrode to be supplied with a voltage having an oscillating component and a surface layer contactable to the member to be charged and a support between said electrode and said surface layer to support said surface layer, wherein a cavity is provided between said electrode and said surface layer, and said support is provided only partially in a longitudinal direction of said roller.

11. A device according to claim 10, wherein the oscillating component have a peak-to-peak voltage which is not less than twice and absolute value of a charge starting voltage relative to the member to be charged.

12. A device according to claim 10, wherein said surface layer has a thickness t satisfying 10 μm<t<10000 μm.

13. A device according to claim 10, wherein said cavity is disposed adjacent said electrode.

14. A device according to claim 10, wherein said cavity is sealed.

15. A device according to claim 10 or 14, wherein said charging member has a power supply portion for supplying a voltage to said surface layer through said electrode.

16. A device according to claim 15, wherein said power supply portion is disposed adjacent a longitudinal end of said charging member.

17. A device according to claim 10, wherein said surface layer includes a first resistance layer contactable to the member to be charged and having a first volume resistivity and a second resistance layer inside said first resistance layer and having a second volume resistivity which is smaller than the first volume resistivity.

18. A device according to claim 10, wherein said cavity has substantially an identical configuration in any longitudinal section including an axis of said charging member.

19. A process unit detachably mountable to an image forming apparatus, comprising:

a member to be charged capable of bearing an image;

a charging member for charging a surface of the member to be charged, said charging member being in a form of a roller;

said charging member including an electrode to be supplied with a voltage having an oscillating component and a surface layer contactable to the member to be charged and a support between said electrode and said surface layer, wherein a cavity is provided between said electrode and said surface layer, and said support is provided only partially in a longitudinal direction of said roller.

20. An image forming apparatus comprising:

a member to be charged capable of bearing an image;

a charging member for charging a surface of the member to be charged, said charging member being in the form of a roller;

said charging member including an electrode to be supplied with a voltage having an oscillating component and a surface layer contactable to the member to be charged and a support between said electrode and said surface layer, wherein a cavity is provided between said electrode and said surface layer, and said support is provided only partially in a longitudinal direction of said roller.

21. A device according to claim 20, wherein the oscillating component have a peak-to-peak voltage which is not less than twice and absolute value of a charge starting voltage relative to the member to be charged.

22. A device according to claim 20, wherein said surface layer has a thickness t satisfying 10 μm<t<10000 μm.

23. A charging member according to claim 10, wherein said cavity is provided such that relative movement is effected between said charging member and the member to be charged.

24. A charging member according to claim 20, wherein said cavity is provided such that relative movement is effected between said charging member and the member to be charged.

25. A charging roller according to claim 1, wherein said cavity is in the form of a ring in partial cross-section, taken along a plane perpendicular to the longitudinal direction, of said roller.

26. A charging device according to claim 10, wherein said cavity is in the form of a ring in partial cross-section, taken along a plane perpendicular to the longitudinal direction, of said roller.

27. A process unit according to claim 19, wherein said cavity is in the form of a ring in partial cross-section, taken along a plane perpendicular to the longitudinal direction, of said roller.

28. An image forming apparatus according to claim 20, wherein said cavity is in the form of a ring in partial cross-section, taken along a plane perpendicular to the longitudinal direction, of said roller.

* * * * *

UNITED STATES PATENT AND TRADEMARK OFFICE

CERTIFICATE OF CORRECTION

PATENT NO. : 5,541,711 Page 1 of 2

DATED : July 30, 1996

INVENTOR(S) : HIROKI KISU, ET AL.

It is certified that error appears in the above-indentified patent and that said Letters Patent is hereby corrected as shown below:

ON THE COVER PAGE

Item: [56] References Cited

FOREIGN PATENT DOCUMENTS

"01179957 7/1989 Japan" should read --1-179957 7/1989 Japan--.

COLUMN 4

Line 13, "result." should read --results.--; and

Line 22, "drum i" should read --drum 1--.

COLUMN 6

Line 50, "imagewisely" should read --image-wisely--.

COLUMN 7

Line 53, "have" should read --has--; and

Line 54, "twice and" should read --twice an--.

UNITED STATES PATENT AND TRADEMARK OFFICE

CERTIFICATE OF CORRECTION

PATENT NO. : 5,541,711 Page 2 of 2

DATED : July 30, 1996

INVENTOR(S) : HIROKI KISU, ET AL.

It is certified that error appears in the above-indentified patent and that said Letters Patent is hereby corrected as shown below:

COLUMN 8

Line 37, "have" should read --has--; and
Line 38, "twice and" should read --twice an--.

Signed and Sealed this

Twenty-fifth Day of March, 1997

*Attest:*

Bruce Lehman

BRUCE LEHMAN

*Attesting Officer*

*Commissioner of Patents and Trademarks*